US005940931A

United States Patent [19]

Jeon

[11] Patent Number: 5,940,931

[45] Date of Patent: Aug. 24, 1999

[54] VACUUM CLEANER

[75] Inventor: Young-Il Jeon, Kwangju, Rep. of Korea

[73] Assignee: Samsung Kwang-Ju Electronics Co., Ltd., Kwangju, Rep. of Korea

[21] Appl. No.: 08/972,882

[22] Filed: Nov. 18, 1997

[30] Foreign Application Priority Data

Jul. 22, 1997 [KR] Rep. of Korea ..... 97-34309

[51] Int. Cl.[6] ..... A47L 5/00

[52] U.S. Cl. ..... 15/339; 55/374

[58] Field of Search ..... 15/339; 55/374, 55/DIG. 34

[56] References Cited

U.S. PATENT DOCUMENTS 2,742,105 4/1956 Dow ..... 15/339
4,044,421 8/1977 Kristenson et al. ..... 15/339
4,766,639 8/1988 Lindquist et al. ..... 15/339

*Primary Examiner*—David A. Redding
*Attorney, Agent, or Firm*—Majestic, Parsons, Siebert & Hsue P.C.

[57] ABSTRACT

A vacuum cleaner erroneous closing apparatus is provided to prevent a dust cover from being closed when a dust collector is not mounted, thereby refraining a motor from being damaged by the dust collected when a vacuum cleaner is operated without the dust collector, the apparatus comprising an erroneous closing prevention unit hinged at a designated position at the low main body for enabling the dust cover to be closed when the dust collector board is inserted onto dust collector fitting part of the low main body and for stopping the closure of the dust cover when the dust collector is not mounted, and a compression spring fixed at designated positions of the low main body and of the erroneous closing prevention unit to apply turning effect toward a direction which prohibits the dust cover from being closed.

2 Claims, 1 Drawing Sheet

VACUUM CLEANER

BACKGROUND OF THE INVENTION

1. Field of the Invention

The present invention relates to a vacuum clean for preventing a dust cover from closing when a dust collector is not mounted, thereby refraining a motor from being damaged by the dust collected when a vacuum cleaner is operated without a dust collector.

2. Description of the Prior Art

A conventional vacuum cleaner, as shown in FIG. 1, comprises a hose connecting member(10), a low main body(20) connected to the hose connecting member(10) having absorption driving means, etc., to get a dust collector (a) securely inserted thereonto, a dust cover(30) hinged at the rear part of the low main body(20) for forming a closed space by way of sealing members(31, 32 and 33) and an erroneous closing prevention apparatus(40) for preventing the dust cover(30) from closing when the dust collector(a) is not mounted at a designated position of the low main body(20).

The erroneous closing prevention apparatus(40) as shown in FIGS. 1 And 2, includes an erroneous closing prevention unit(41) for enabling a dust collector board(b) to be firmly inserted into the low main body(20) by being hinged at a designated position of the low main body(20) and for controlling the closure of the dust cover(30) when the dust collector is not mounted, and a compression spring(42) fixed at a designated position of the low main body(20) and at a designated position of the erroneous closing prevention unit(41) for permitting the unit(41) to apply a turning effect to a direction which refrains the dust cover(30) from closing.

At this time, the erroneous closing prevention unit(41) comprises a turning hole(41*a*), a front protruder(41*b*) for supporting the front side of the dust collector board(b), a rear protruder(41*c*) for supporting the rear side of the board(b), a handle part(41*d*) protruded to manually turn the erroneous closing prevention unit(41), a closing prevention protruder (41*e*) protruded to refrain the dust cover(30) from closing when the erroneous prevention apparatus is turned toward the dust collector(a), and a spring fixing surface(41*f*) for fixing the other end of the compression spring.

Accordingly, the erroneous closing prevention unit(41) of the erroneous closing prevention apparatus(40) should be returned after it is turned against the elasticity of the compression spring(42) to insert the dust collector into a dust collector fitting part(21) in the low main body(20). Therefore, the front and rear protruders(41*b* and 41*c*) of the erroneous closing prevention unit(41) firmly takes and supports the dust collector(a) not to be dropped.

Furthermore, when the dust cover(30) is turned and closed, a closing protruder(34)of the dust cover(30) is tightly attached to a sealing member(32) without being blocked by a closing prevention protruder(41*e*), thereby prohibiting foreign objects from being infused into the vacuum cleaner.

On the other hand, when the dust collector(a) is not mounted, the dust cover is not be erroneously closed because erroneous closing prevention unit(41) is rotated by the compression spring(42), the rear protruder(41*c*) is placed into the top part of the dust collector fitting part(21), and the erroneous closing prevention protruder(35) at the dust cover (30) is blocked by the closing prevention protruder(41*e*) of the erroneous closing prevention unit(41).

SUMMARY OF THE INVENTION

However, when a handle part(41*d*) of the erroneous closing prevention unit(41) disposed at the erroneous closing prevention apparatus(40) blocks the worker's sight, or when the board(b) is too long, the dust collector board(b)of the dust collector(a) may not be precisely inserted between the front and rear protruders(41*b* and 41*c*), i.e., incorrectly mounted, thereby causing a problem in that a motor can be damaged by the dust infused inside the vacuum cleaner during vacuum cleaning.

In addition, when a rib of the dust collector fitting part(21) is too long, a space for enabling the ends of the front and rear protruders(41*b* and 41*c*) to be turned and for enabling the board(b) to be mounted at the dust collector fitting part(21) is not properly provided, thereby causing a problem in that the dust collector board(b) cannot be firmly supported.

The present invention is presented to solve the aforementioned problems and it is an object of the present invention to provide a vacuum cleaner erroneous closing prevention apparatus by which shape thereof is much simplified to be easily produced for product improvement.

In order to achieve the object of the present invention, there is provided a vacuum cleaner erroneous closing prevention apparatus which refrains a dust cover from being closed when a dust collector is not mounted at a dust collector fitting part of a low main body having absorption driving means, the apparatus comprising:

an erroneous closing prevention unit hinged at a designated position of the low main body for enabling the dust cover to be closed when a dust collector board is inserted onto dust collector fitting part of the low main body and for stopping the closure of the dust cover when the dust collector is not mounted; and a compression spring fixed at a designated position at the low main body and at the erroneous closing prevention unit to apply turning effect toward a direction which prohibits the dust cover from being closed.

BRIEF DESCRIPTION OF THE DRAWINGS

For fuller understanding of the nature and objects of the invention, reference should be made to the following detailed description taken in conjunction with the accompanying drawings in which.

DETAILED DESCRIPTION OF THE INVENTION

Figure 1:
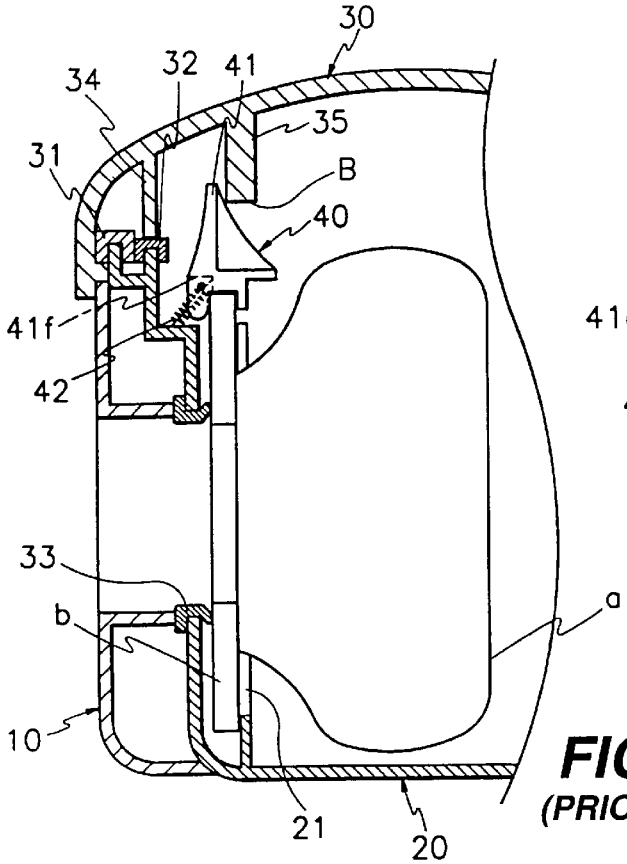
FIG. 1 (PRIOR ART)
FIG. 1 is a fragmentary sectional view for illustrating a conventional vacuum cleaner including an erroneous closing prevention apparatus for a dust cover according to the prior art.
Figure 2:
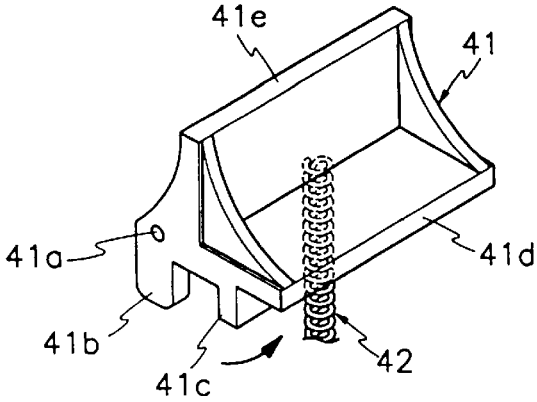
FIG. 2 (PRIOR ART)
FIG. 2 is a perspective view for illustrating the installation state of an erroneous closing prevention unit and a compression spring according to the prior art.
Figure 3:
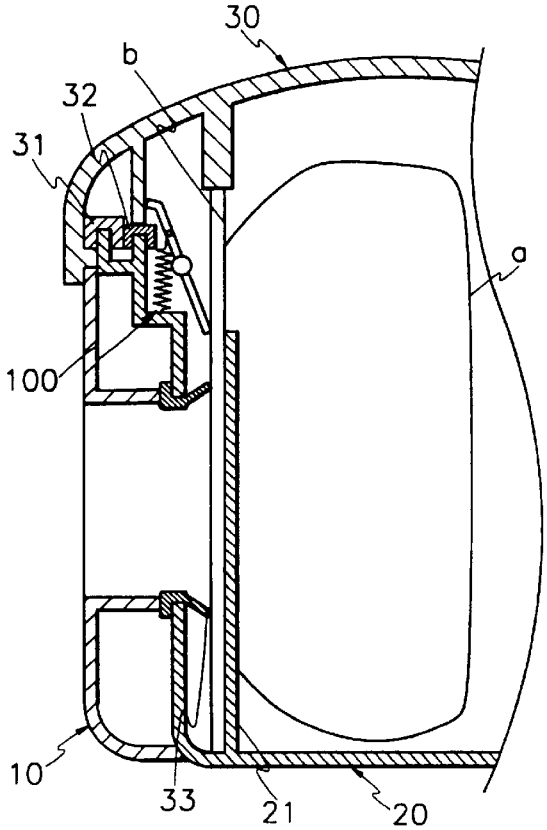
FIG. 3 is a fragmentary sectional view for illustrating a vacuum cleaner erroneous closing prevention apparatus according to the present invention.
Figure 4:
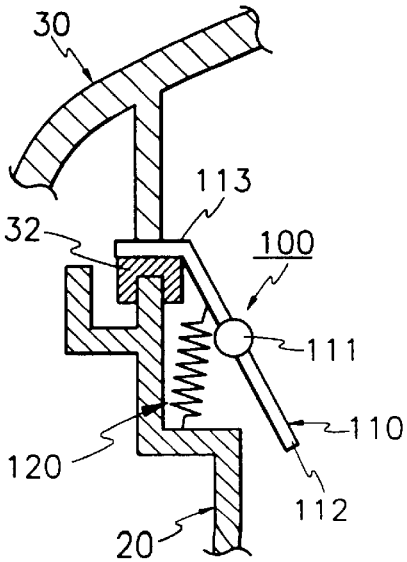
FIG. 4 is a fragmentary sectional view for illustrating the unclosed state of a dust cover by way of an erroneous closing prevention unit according to the present invention.

The present invention is described in detail with reference to the accompanying drawings. FIG. 3 is a fragmentary sectional view for illustrating a vacuum cleaner erroneous closing prevention apparatus according to the present invention, FIG. 4 is a fragmentary sectional view for illustrating the unclosed state of a dust cover by way of an erroneous closing prevention unit according to the present invention. Explanation is omitted for some parts of the FIGS. 3 and 4 that are same as those of the FIGS. 1 and 2 as the identical labels and numbers are referred.

In the present invention there is provided a vacuum cleaner erroneous closing prevention apparatus(100) comprising an erroneous closing prevention unit(110) hinged at a designated position of the low main body(20) for enabling the dust cover(30) to be closed when the dust collector board(b) is inserted into dust collector fitting part(21) of the low main body(20) and for prohibiting the closure of the dust cover(30) when the dust collector is not mounted, and a compression spring(120) fixed at designated positions of the low main body(20) and of the erroneous closing prevention unit(110) to apply turning effect toward a direction which refrains the dust cover(30) from being closed.

Furthermore, the erroneous closing prevention unit(110) includes a hinge part(111), a dust collector detecting part (112) to be contacted to the dust collector board(b) when the dust collector board(b) is inserted onto the dust collector fitting part(21), and a closing prevention part(113) extended at an opposite direction to the dust collector detecting part(112) and folded at a predetermined angle at an end thereof, the closing prevention part(113) which is contacted to a closed protruder(34) of the dust cover(30) when the dust collector(a) is not mounted.

Next, the operational effect of the present invention is described in detail below. When the dust collector board(b) is pushed down from the top of the erroneous closing prevention unit(110) of the erroneous closing prevention apparatus(100) to be inserted at the dust collector fitting part(21), the dust collector detecting part(112) of the erroneous closing prevention unit(110) is turned at a center of the hinge part(111) to move the closing prevention part(113) of the erroneous closing prevention unit(110) toward the dust collector(a), whereby the dust cover(30) is correctly closed onto the low main body(20) without being disturbed by the closing protruder(34).

On the other hand, in case the dust collector board(b) is not inserted onto the dust collector fitting part(21) of the low main body(20), the compression spring(120) turns the closing prevention part(113) at a center of the hinge part(110) to be placed onto the scaling member(32), whereby the dust cover(30) can not be connected to the low main body(20).

Apparent from the foregoing, even if the erroneous closing prevention unit(110) of the erroneous closing prevention appartauts(100) in the present invention has a much simplified structure, the erronous closing prevention apparatus (100) turns out to be more effective even when the length of the dust collector board is longer than the conventional one.

According to the present invention, there is an advantage in that the shape of the erroneous closing prevention unit is much simplified for convenient production. There is another advantage in that the dust collector board can be easily inserted and firmly fixed not to leak dust and the erroneous closing of the dust cover can be effectively prevented even when the rib of the dust collector fitting part is higher than the conventional one.

Even if an embodiment of the present invention is described here, the actual scope of the present invention is not limited in the presented embodiment. It is believed evident that many variations be made by those skilled in the art without departing from the spirit and scope of this invention.

What is claimed is:

1. A vacuum cleaner erroneous closing prevention apparatus for preventing a dust cover from closing onto a low main body of a vacuum cleaner when a dust collector is not mounted at said low main body, comprising:

an elongated member having a first end and a second end, said member rotatable around an axis affixed to said low main body between an opening position and a closing position, said first and second ends being on opposite sides of said axis; and a compression spring affixed to and between said low main body and said elongated member for applying a biasing force on said elongated member, wherein when a dust collector board of said dust collector is not inserted into a dust collector fitting part of said low main body, said biasing force rotates said elongated member to said opening position in which said first end prevents said dust cover from closing onto said low main body, and wherein when said dust collector board is inserted into said dust collector fitting part, a top surface of said dust collector board applies a displacing force on said second end that is greater than said biasing force and that thereby rotates said elongated member to said closing position in which said first end does not prevent said dust cover from closing onto said low main body.

2. The vacuum cleaner erroneous closing prevention apparatus of claim 1, wherein said first end is extending at an opposite direction to said second end and folding at a predetermined angle at an end thereof.

* * * * *